US011357297B2

(12) United States Patent
Buch-Jakobsen

(10) Patent No.: US 11,357,297 B2
(45) Date of Patent: Jun. 14, 2022

(54) BAG, IN PARTICULAR A SHOPPING BAG, AND A METHOD FOR FORMING SAID BAG

(71) Applicant: NUMERUS HOLDING APS, Alsgarde (DK)

(72) Inventor: Maria Nouvel Buch-Jakobsen, Alsgarde (DK)

(73) Assignee: NUMERUS HOLDING APS, Alsgarde (DK)

( * ) Notice: Subject to any disclaimer, the term of this patent is extended or adjusted under 35 U.S.C. 154(b) by 527 days.

(21) Appl. No.: 16/338,753

(22) PCT Filed: Oct. 3, 2017

(86) PCT No.: PCT/DK2017/050327
§ 371 (c)(1),
(2) Date: Apr. 2, 2019

(87) PCT Pub. No.: WO2018/065020
PCT Pub. Date: Apr. 12, 2018

(65) Prior Publication Data

US 2021/0282514 A1 Sep. 16, 2021

(30) Foreign Application Priority Data

Oct. 3, 2016 (DK) ..... PA 2016 00589

(51) Int. Cl.
*A45C 3/04* (2006.01)
*B31B 70/26* (2017.01)
(Continued)

(52) U.S. Cl.
CPC ..... *A45C 3/04* (2013.01); *A45C 7/0095* (2013.01); *A45C 13/02* (2013.01); *A45F 3/04* (2013.01);
(Continued)

(58) Field of Classification Search
CPC ..... A45C 13/02; A45C 3/04; A45C 7/0095; A45C 2007/0004; B31B 70/26;
(Continued)

(56) References Cited

U.S. PATENT DOCUMENTS 888,653 A * 5/1908 Potter ..... B65D 33/06 D9/706
996,746 A * 7/1911 Bloomer ..... B65D 5/06 229/138
(Continued)

FOREIGN PATENT DOCUMENTS

FR 748654 A 7/1933
FR 1557912 A 2/1969
(Continued)

OTHER PUBLICATIONS

Danish Search Report for Application No. PA 2016 00589, dated Mar. 16, 2017.
(Continued)

*Primary Examiner* — Peter N Helvey
(74) *Attorney, Agent, or Firm* — Pearne & Gordon LLP

(57) ABSTRACT

The invention relates to a folded bag and a method for forming a bag from a square or rectangular shaped sheet, which method comprises the steps of dividing the sheet into nine fields arranged such that eight fields surround a central field; folding the sheet along folding-lines between and across the fields in such a way that the central field forms the bottom of the bag and the eight surrounding fields form the sides of the bag and at least one inner wall providing separated compartments in the bag.

17 Claims, 13 Drawing Sheets

(51) Int. Cl.

| | |
|---|---|
| ***A45C 7/00*** | (2006.01) |
| ***A45C 13/02*** | (2006.01) |
| ***A45F 3/04*** | (2006.01) |
| ***B65D 30/20*** | (2006.01) |
| ***B65D 33/10*** | (2006.01) |
| *B31B 150/00* | (2017.01) |

(52) U.S. Cl.
CPC ..... *B31B 70/26* (2017.08); *B65D 31/10* (2013.01); *B65D 33/105* (2013.01); *A45C 2007/0004* (2013.01); *B31B 2150/001* (2017.08)

(58) Field of Classification Search
CPC ..... B31B 2150/001; A45F 3/04; B65D 31/10; B65D 33/105
USPC ..... 493/243
See application file for complete search history.

(56) References Cited

U.S. PATENT DOCUMENTS

| | | | | |
|---|---|---|---|---|
| 2,443,531 | A | 6/1948 | Berch | |
| 3,207,357 | A * | 9/1965 | Schmitt | B65D 5/68 229/189 |
| 4,687,130 | A * | 8/1987 | Beeler | B65D 5/247 229/152 |
| 5,062,527 | A * | 11/1991 | Westerman | B65D 5/68 229/117.06 |
| 5,294,043 | A * | 3/1994 | Platt | B65D 5/6629 229/128 |
| 5,562,228 | A * | 10/1996 | Ericson | F25D 3/08 220/592.2 |
| 6,736,309 | B1 * | 5/2004 | Westerman | B65D 5/46144 229/148 |
| 6,837,420 | B2 * | 1/2005 | Westerman | B65D 5/2057 229/117.15 |
| 7,188,713 | B1 * | 3/2007 | Espar | A45F 4/06 383/4 |
| 7,841,512 | B2 * | 11/2010 | Westerman | B65D 5/6697 229/149 |
| 9,457,929 | B2 * | 10/2016 | Jenkins | B65D 5/242 |
| 9,499,294 | B1 * | 11/2016 | Costanzo, Jr. | B65D 5/4608 |
| 10,661,941 | B2 * | 5/2020 | Genender | B65D 5/443 |
| 11,104,474 | B1 * | 8/2021 | Kim | B65D 81/3858 |
| 2010/0177986 | A1 | 7/2010 | Kohn et al. | |
| 2014/0263593 | A1 | 9/2014 | Vasbinder et al. | |
| 2015/0125096 | A1 | 5/2015 | Mulholland et al. | |

FOREIGN PATENT DOCUMENTS

| | | | |
|---|---|---|---|
| GB | 120807 | A | 11/1918 |
| GB | 792826 | A | 4/1958 |
| GB | 2415956 | A | 1/2006 |
| JP | 2003-135120 | A | 5/2003 |
| WO | 2013/159457 | A1 | 10/2013 |

OTHER PUBLICATIONS

International Search report for International Application No. PCT/DK2017/050327, dated Nov. 7, 2017.
European Search Report for Application No. 17857873.8, dated Apr. 8, 2020.

* cited by examiner

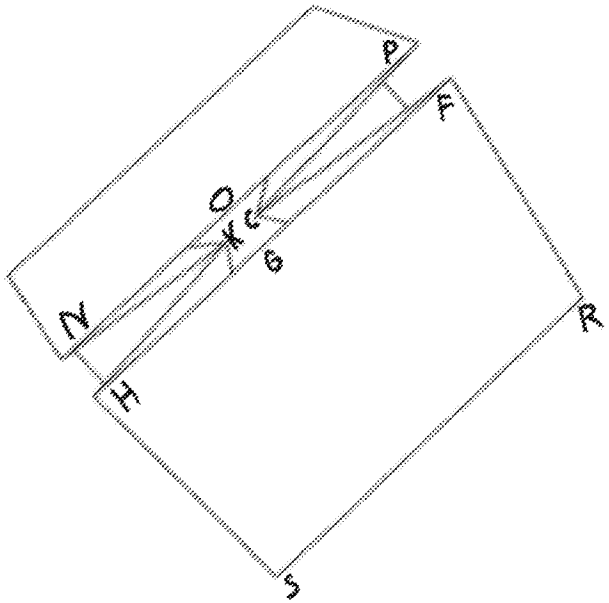
Figure 9
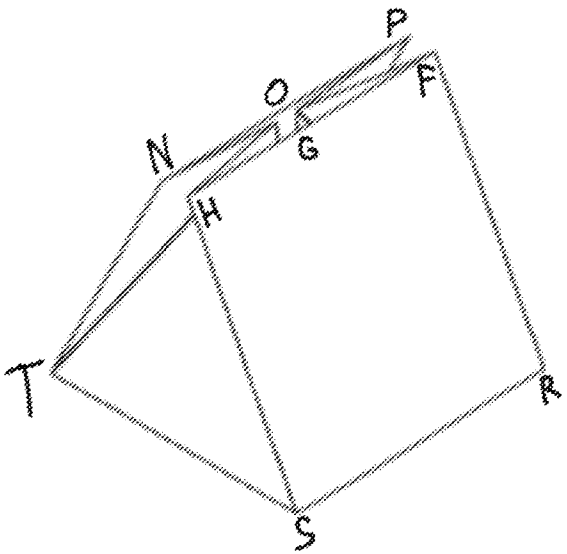

BAG, IN PARTICULAR A SHOPPING BAG, AND A METHOD FOR FORMING SAID BAG

TECHNICAL FIELD

The present invention relates to a folded bag, in particular a shopping bag, and a folding technique which, on the basis of square shaped sheet and the use of the special folding technique in connection with the production, forms a multi-compartment shopping bag to allow for more vulnerable purchases such as e.g. macaroons, strawberries, flowers and eggs to be stored in separate compartments in the shopping bag.

BACKGROUND

Shopping bags are used in huge numbers all over the world. The shopping bag according to the present invention is intended as an alternative to the many billion plastic bags that are used worldwide annually—in Denmark alone there is used approximately 440 million plastic bags each year.

Today there are many types of shopping bags and mule bags available. Japanese Patent Application JP2003135120 A describes a shopping bag that can be folded from a square shaped sheet material. However, the folded bag contains only one compartment.

When the consumer is shopping in e.g. a super market the consumer is able to buy many different items, some of which are more fragile than others. However, at present the shops and super markets offer only one kind of shopping bag for consumer to carry his purchase. This is typically a plastic bag with a single compartment for the purchased items, and in this type of bag fragile items have to be mixed with less fragile items. Also it is not possible to separate items which give off odor from other items.

DISCLOSURE OF THE INVENTION

The object of the present invention is to provide a bag and in particular, a shopping bag comprising separated compartments.

A further object is to provide a bag which can be manufactured with a minimum waste of material.

The invention also provides a method for folding a square shaped sheet into a bag comprising separate compartments.

The bag or shopping bag according to the invention can be folded in and out as needed and can be worn either in the hand, on the arm, on the shoulder or on the back.

The present invention provides a method by which a square or rectangular shaped sheet can be folded with a particular folding technique to form a multi-compartment bag and form a bag without large waste of material, in fact the bag can folded from the square or rectangular shaped sheet without any material waste at all. The bag and its different possibilities for uses are thus created during with the production and folding of the sheet. The resulting bag can be used as a shopping bag or the bag can be used for other purposes.

Consequently, in one aspect the invention relates to a method for forming a bag from a square or rectangular shaped sheet, which method comprises the steps of dividing the sheet into nine fields arranged such that eight fields surround a central field; folding the sheet along folding-lines between and across the fields in such a way that the central field forms the bottom of the bag and the eight surrounding fields form the sides of the bag and at least one inner wall providing separated compartments in the bag.

The sheet for forming the bag preferable has a thickness of less than 3 mm such as in the range of 0.1 to 1.5 mm, and dimensions, Leo length and width, in the range 0.1 m to 1 m. The length and width are not necessarily identically, i.e. the sheet may have a rectangular shape. The sheet is divided into nine fields, and each of the nine fields have a square or rectangular shape. The sheet is folded along folding lines which are border lines between adjacent fields. However, the sheet may also be folded along folding-lines crossing one or more of the fields. The fields are arranged three and three in a first direction and three and three in a second direction perpendicular to the first direction. In this manner an arrangement is achieved in which a central field is surrounded by eight fields. The fields and folding-lines are not necessarily required to be physically marked on the sheet as a person experienced in folding the sheet will know where the fields and folding lines are placed.

The folding lines are the lines around which the sheet is folded. In an embodiment each folding line is parallel with another folding line when the sheet is in an unfolded condition, i.e. the flat sheet. Moreover, at least two folding lines which are parallel have a direction which will cross the direction of two other parallel folding lines with an angle of 90° when the sheet is in an unfolded condition. The direction of a folding line is parallel or coinciding with the folding line.

The sheet may be made from various material, such as e.g. paper, cardboard, leather, fabric, such as fabric made from cotton, linen or wool, biodegradable materials, plastics, e.g. plastics such as polyethylene, polypropylene and polyurethane. In some embodiments the sheet is made from metal, e.g. aluminium. The sheet may also be made from a combination of different materials, e.g. as a laminated sheet or a fibre reinforced sheet.

When the sheet is folded to form a bag, parts of the bag are assembled for the purpose of maintaining the shape of the bag. The assembling may be done by e.g. gluing, sewing, welding and any other assembling method such as e.g. use of rivets or clips.

The folded bag may be provided with a protective or decorative coating. Text messages, logos and pictures can also be printed or sewn on the bag.

In an embodiment of the method of folding a sheet to form a bag, the method comprises the following steps:

- dividing the square or rectangular sheet into nine fields using twelve consecutively points with four consecutively points on each of the sides of the sheet A, B, D, E, F, H, I, J, L, M, N and P so that the nine fields are defined by lines A to E, E to I, I to M and M to A, and B to L, D to J, F to P and H to N,
- making four cuts from point B to a point A1, from point D to a point E1, from point J to a point I1 and from point L to a point M1; where A1, E1, I1 and M1 are centre points in the four fields forming the corners of the sheet,
- folding the sheet: in a folding-line from point P to point B so point A are folded to meet a point Q; in a folding-line from point D to point F so that point E is folded to meet a point R; in a folding-line from point H to point J so point I is folded to meet a point S; and in a folding line from point L to point N so point M is folded to meet a point T; where Q, R, S and T are the cross-points for the mentioned lines, i.e. the points where the lines are crossing each other,
- folding the sheet further with a fold from point F to point P and a fold from point H to point N and then fold the sheet from point D to point J and from point B to point L and bend upwards; thus, the straight line between point F and point P forms a folding line, which folding line has a direction parallel or coinciding with the line from point F to point P.

bending up the fields defined by the lines between points B to D, D to R, R to Q and Q to B and the lines between points to L, L to T, T to S and S to J, whereby the sections formed by the cuts from point B to a point A1; from point D to point E1; from point J to a point I1, and from point L to a point M1 overlap each other and so that the fields defined by the lines between points B to D, D to R, R to Q and Q to B and the lines between points to L, L to T, T to S and S to J are bent so that they stand substantially vertically on the field defined by the lines between points Q to R, R to S, S to T, and T to Q;

assembling the sections to form a bag having one central compartment in which the central field forms the bottom and compartments on two opposing sides of the central compartment.

The fields in which the four cuts are made are the fields in each corner of the sheet. The cuts are made along a diagonal line in the respective field and extending substantially half through the field.

In an embodiment the method comprises the further steps of:

assembling point B and point P such that the line between point A and point B flush with the line between point Q and point R;

assembling point D and point F such that the line between point D and point E flush with the line between point Q and point R;

assembling point H and point J such that the line between point I and point flush with the line between point S and point T;

assembling point L and point N such that the line between point L and point M flush with the line between point S and point T.

Thus, it is possible to assemble the bag in an uncomplicated manner.

In an embodiment of the method the area defined by the lines A to B, B to L, L to M, M to A are divided into three squares, and the area defined by the lines D to E, E to I, I to J, J to D are divided into three squares. Thus, it is possible to achieve a folded bag with symmetrical dimensions.

It is possible to achieve a more compact bag where point B meets point D, and point L meets point J.

In an embodiment the bag by attachment of the bent end pieces—formed by lines between points B, D, R and Q and points J, L, T and S—appears as a bag with one compartment. Thus it is possible to use the bag as a bag with one compartment.

In an embodiment of the method the end pieces—formed between the points B, D, R and Q and the points J, L, T and S—are folded out such that they by a fold from point C to point Q and a fold from point C to point R, and a fold from point K to point S and a fold from point K to point T form two compartments. Thus a bag with three compartments may be provided.

In an embodiment the end pieces—formed between the points B, D, R and Q and the points J, L, T and S—are folded by folding a line from point C to point Q and folding a line from point C to point R and further folding a line from point K to point S and folding a line from point K to point T so point C and K can meet with point G and point O. This embodiment allows the bag to be folded to a compact structure when not in use.

To allow an even more compact structure the method also provides an embodiment where the end pieces and the bottom are folded in.

The method according to the invention also provides an embodiment where the bag is provided with short and long handles and/or with backpack straps. This embodiment ensures that the bag can be easily carried and transported.

The present invention also provides a shopping bag produced by the method described above.

DETAILED DESCRIPTION OF THE INVENTION

The invention will now be explained with reference to the Figures in which:

FIG. 1: shows the sheet divided into nine fields;

FIG. 2: shows the sheet with four cuts;

FIG. 3: shows the initial folding of the sheet;

FIG. 4: shows folding of the sheet;

FIG. 5: shows folding of the sheet;

FIG. 6: shows folding of the sheet;

FIG. 7: shows the sheet folded as a bag with one compartment;

FIG. 8: shows the sheet folded as a bag with three compartments;

FIG. 9: shows the bag folded with reduced size;

FIG. 10: shows the bag folded with reduced size;

FIG. 11: shows the bag folded with reduced size;

FIG. 12: shows the bag folded with reduced size;

FIG. 13: shows bag with short and long handles and a bag with backpack straps.

FIG. 1 shows the sheet before it is folded. In this embodiment the sheet is a square. The square is divided into nine fields, which square shaped. The areas A to B, B to L, L to M, M to A are divided into 3 squares, and the areas D to E, E to I, I to J, to D are divided into 3 squares.

FIG. 2 shows how 4 cuts are made in the sheet. Cuts are made from point B to point A1, from point D to point E1, from point J to point I1, from point L to point M1.

In FIG. 3 the corners of the 4 corner fields are bend over the cut as follows: A fold is made from point P to point B so that point A is folded to point Q. A fold is made from point D to point F so that Point E is folded to point R. A fold is made from point H to point J so that point I is folded to point S. A fold is made from point L to point N so that point M is folded to point T.

In FIG. 4 the side pieces (the sides where the fields at the 4 corners are bent over the cut) are bend up: From point P to point F, one fold is made, and from point N to point H, a fold is made, after which the side piece from point D to point J and side section from point B to point L are bend up.

In the FIGS. 5 and 6 it is shown how the end pieces point Q to point R and point S to point T bend up, whereby the sections formed by the cuts in FIG. 2 overlap each other. These sections are assembled by use of any suitable attachment means, such as sewing or gluing. It is in this process that a total of 3 compartments are formed, one in the middle and one on each side of the folded bag. Tip from point B reach point R, tip from point D reach point Q, tip from point L reach point S, tip from point J reach point T.

The section from point B to point D and the section from point J to point L bend toward the center of the figure so that they stand substantially vertically on the section point Q to point R and the section point S to point T.

Point B and point P are assembled such that the section between point A and point B substantially flush with the section between point Q and point R.

Point D and point F are assembled such that the section between point D and point E substantially flush with the section between point Q and point R.

Point H and point J are assembled such that the section between point I and point J substantially flush with the section between point S and point T.

Point L and Point N are assembled such that the section between point L and point NI substantially flush with the section between point S and point T.

FIG. 9 shows that the end pieces, point B to point D and point to point L, can be folded to reduce the size of the bag.

Point C through fold from point C to point Q and fold from point C to point R and point K bend via fold from point K to point S and fold from point K to point T so that they are assembled at the top with point G and point O.

Figure 1:
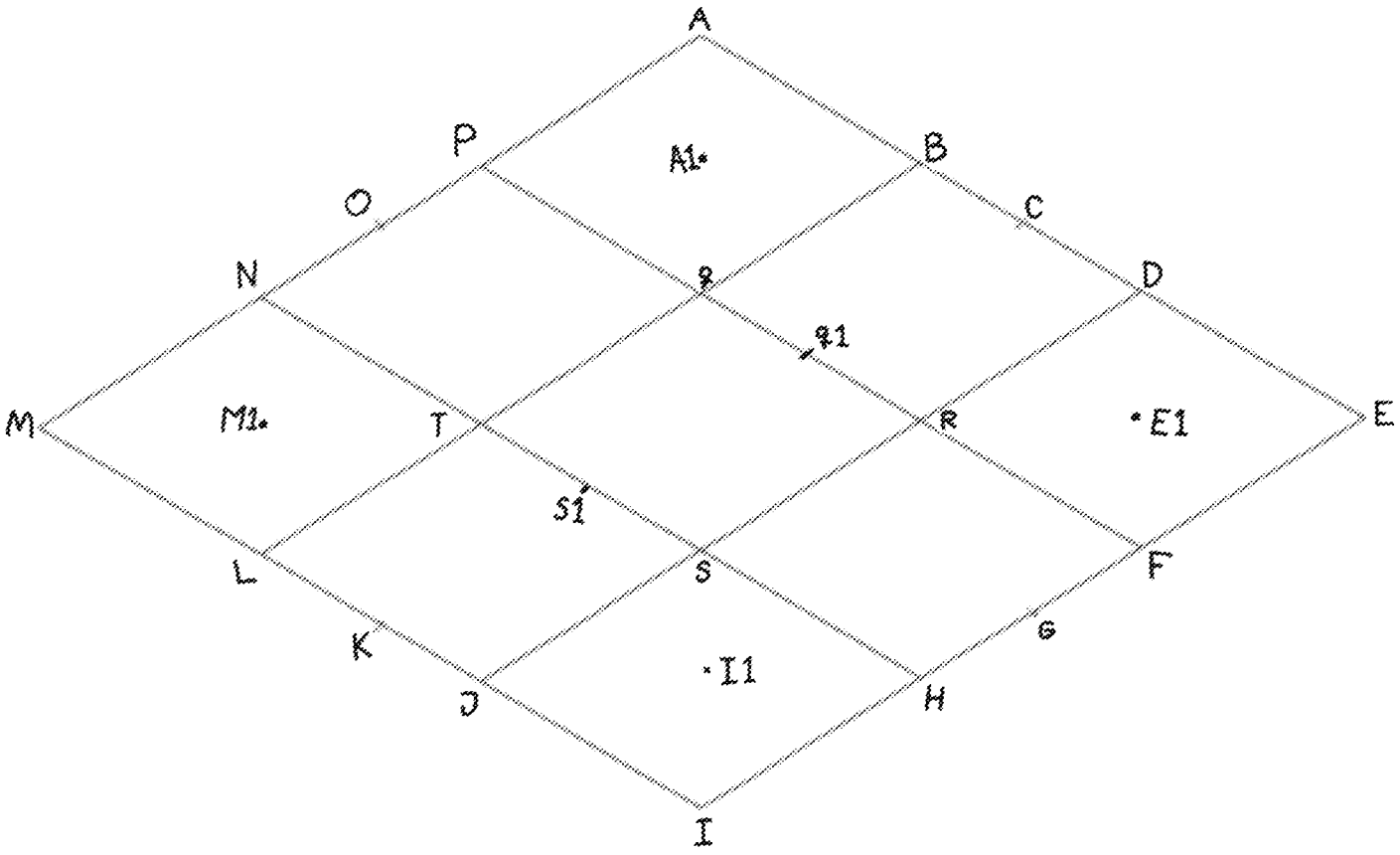
Figure 2:
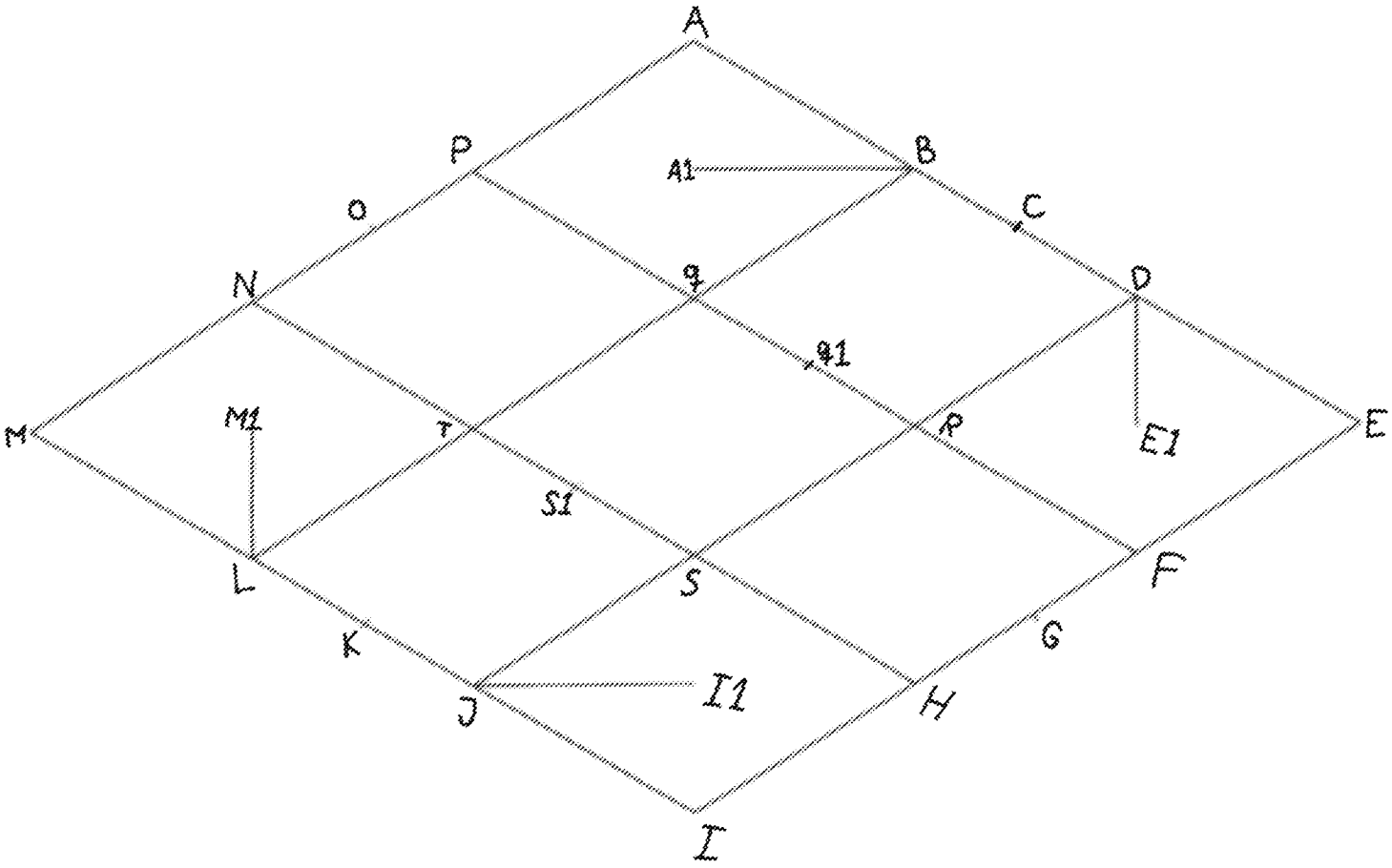
Figure 3:
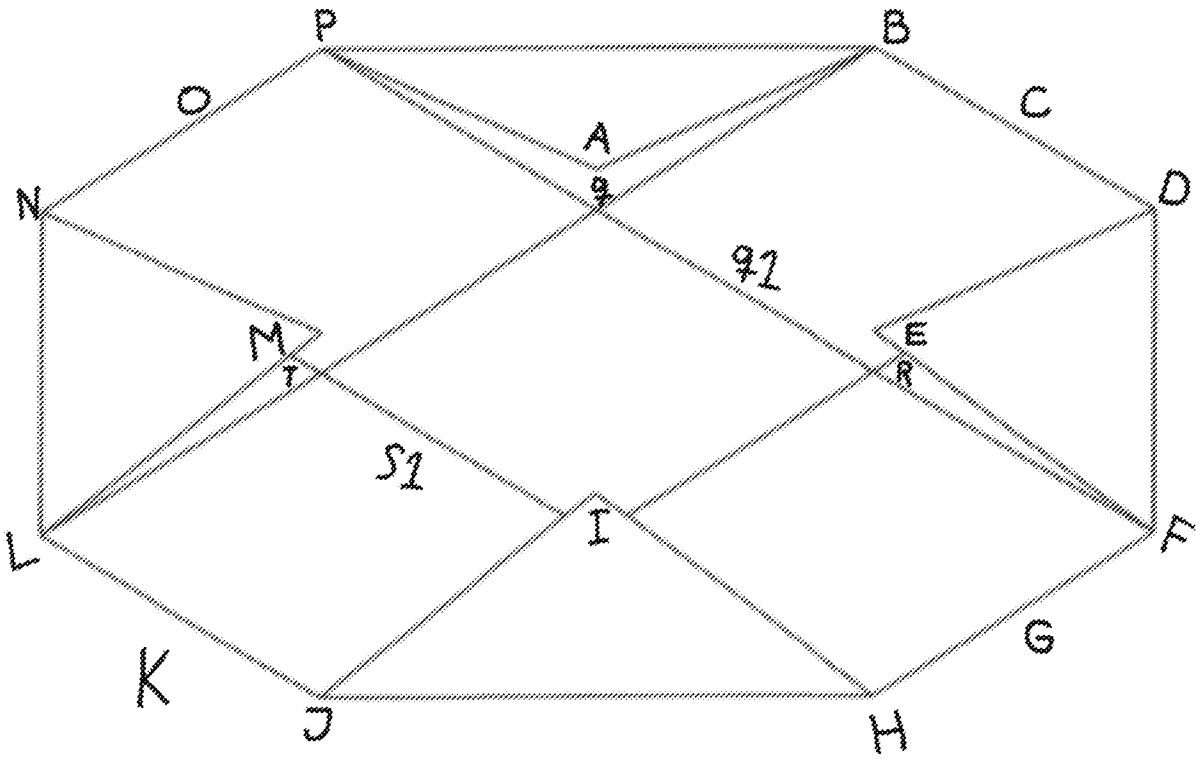
Figure 4:
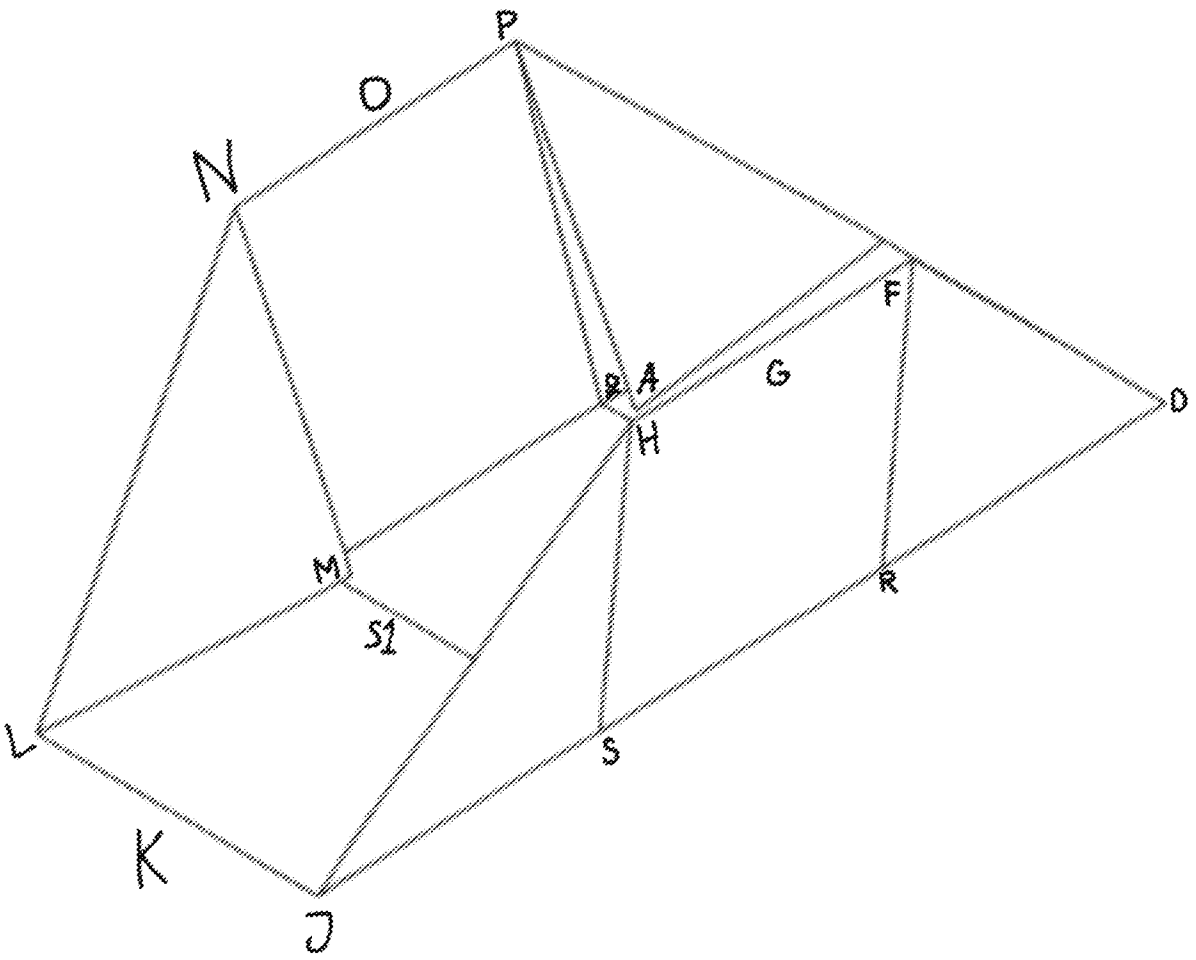
Figure 5:
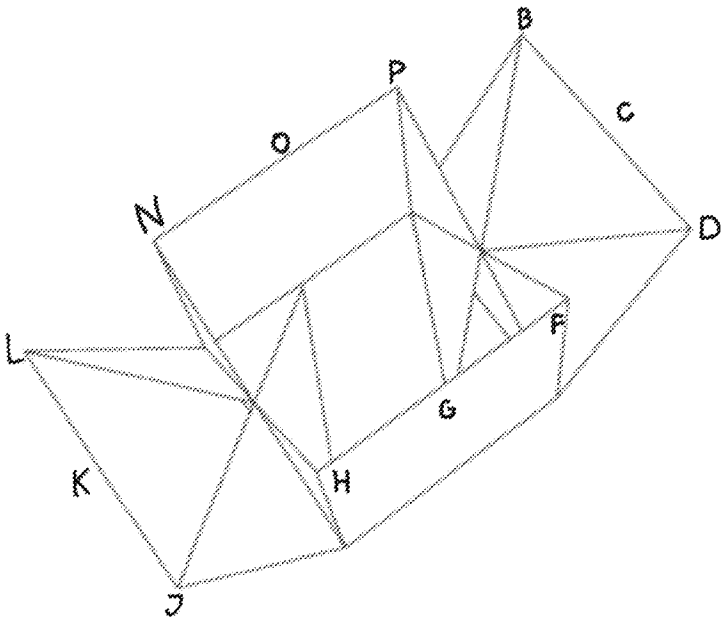
Figure 5:
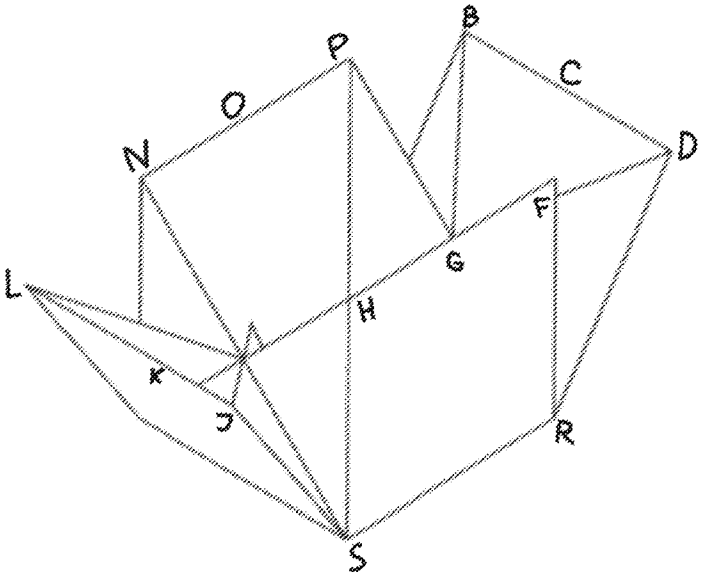
Figure 6:
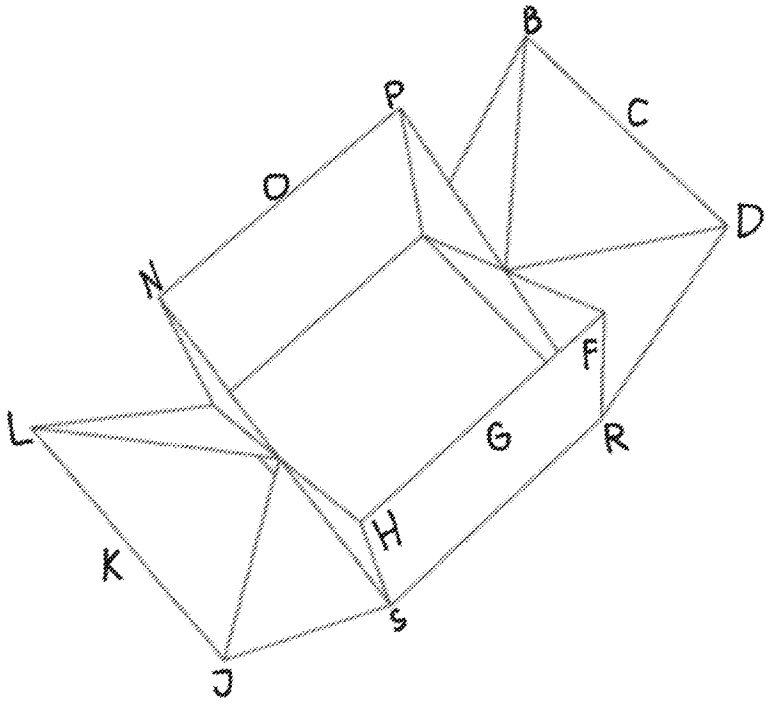
Figure 6:
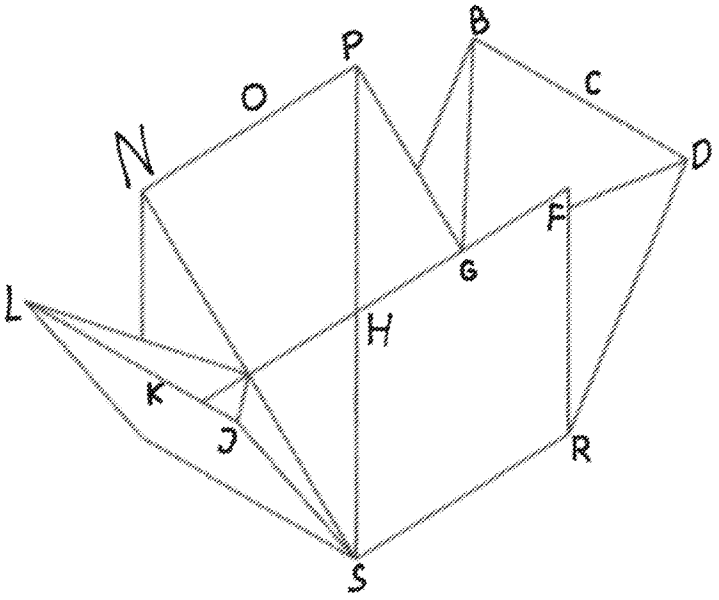
Figure 7:
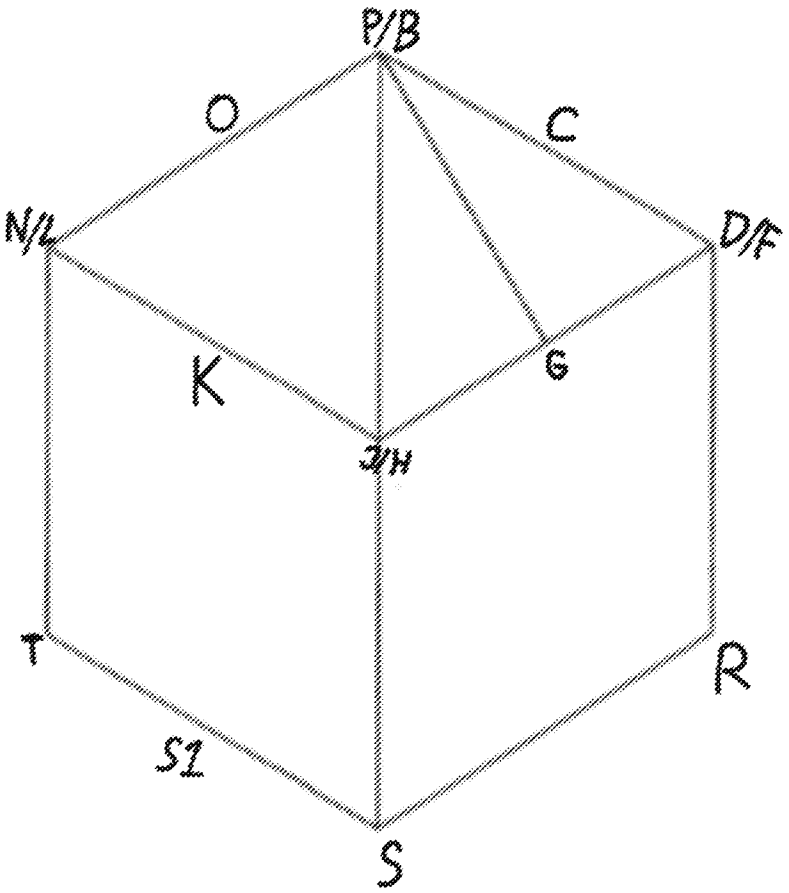
FIG. 7 shows that the bag can be utilized as a 1-compartment bag with attachment of the bent end pieces—point B to point D and point J to point L.
Figure 8:
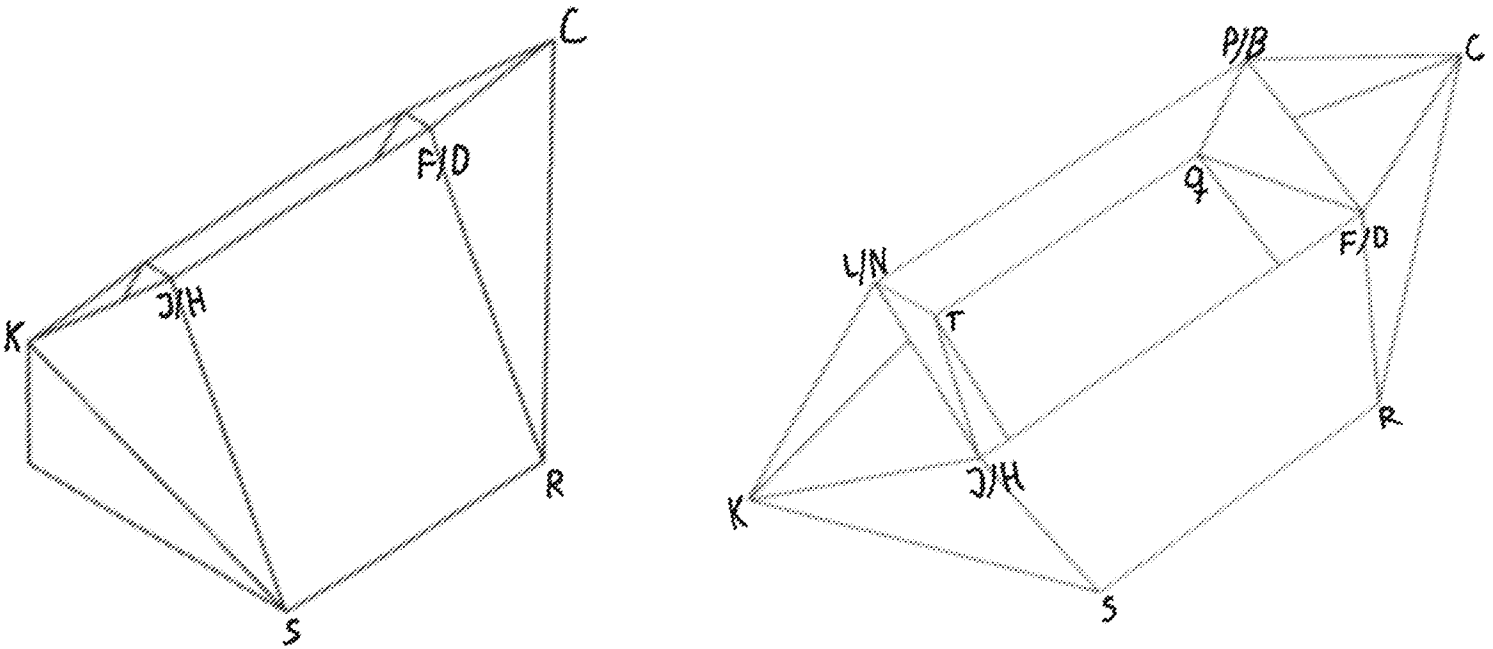
FIG. 8 shows that end pieces—point B to point D and point J to point L—can be folded to form 2 extra compartments. Fold from point C to point Q and fold from point C to point R, and fold from point K to point S and fold from point K to point T are used for this purpose.
Figure 10:
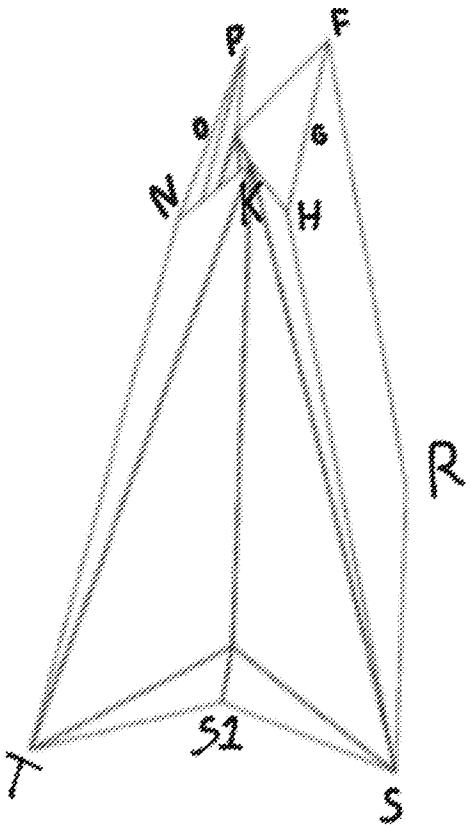
Figure 10:
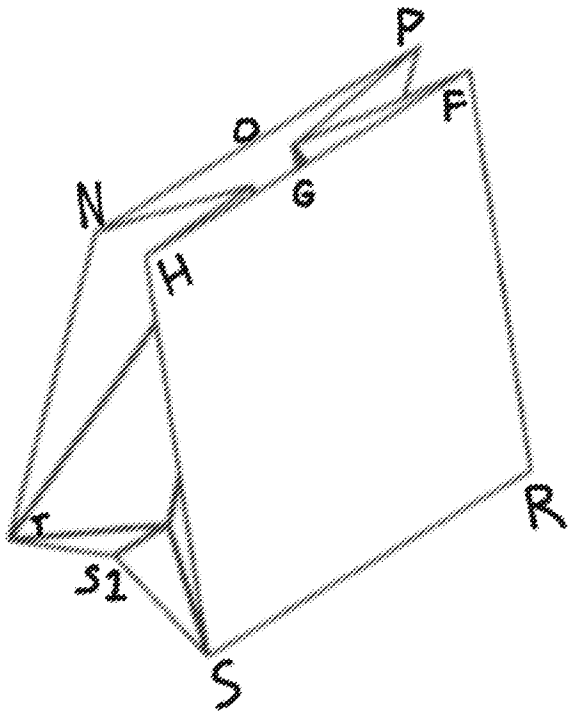

FIG. 10: The bottom can be folded in. A fold is made between point Q1 and point S1 which folds in the bag, whereby point Q and point R meet and point S and point T meet.

Figure 11:
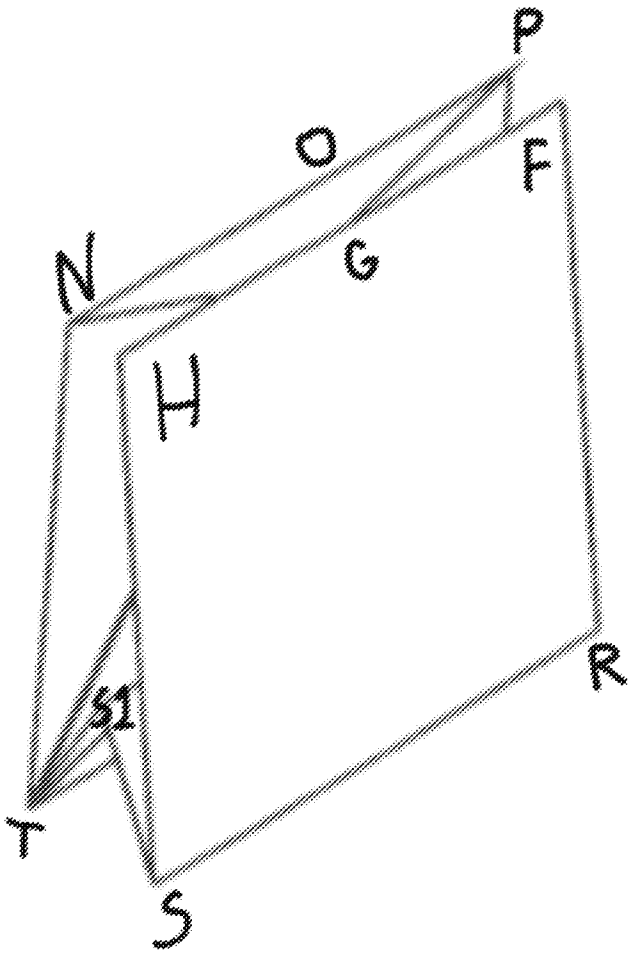

FIG. 11 shows the bag where both end pieces and bottom are folded in.

Figure 12:
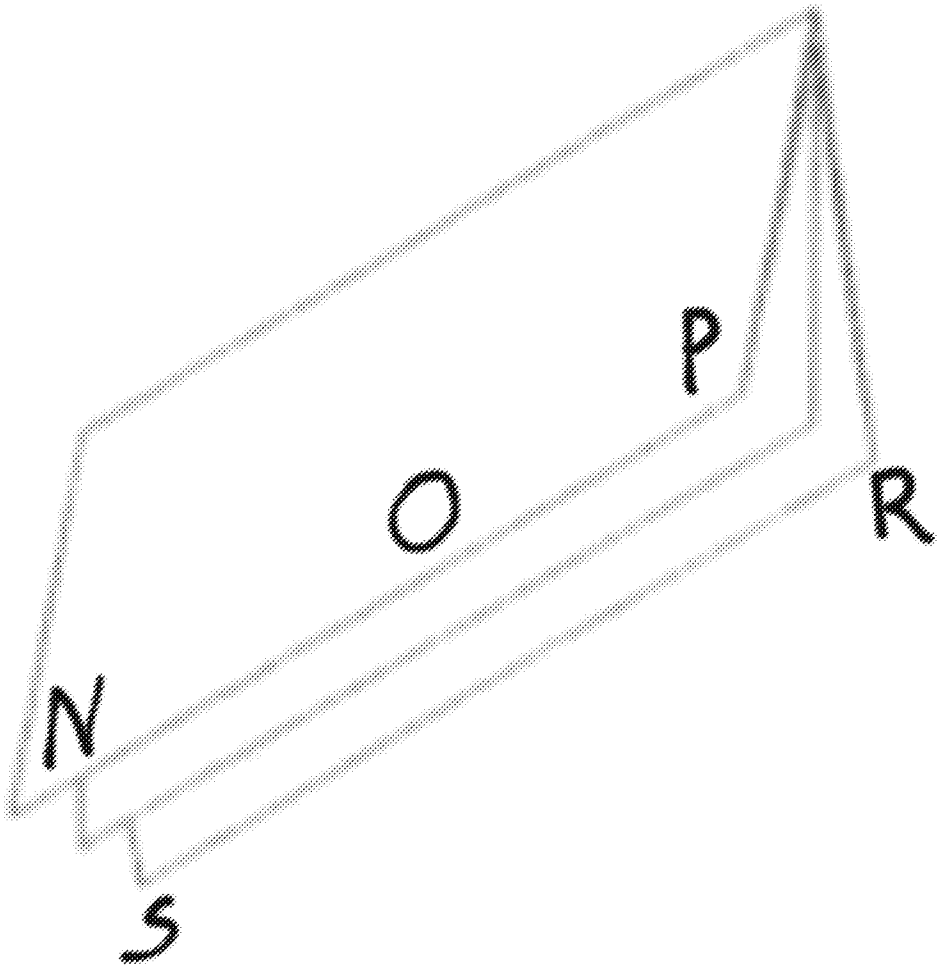

FIG. 12 shows the bag in FIG. 11 with an extra fold reducing the size of the bag.

Figure 13:
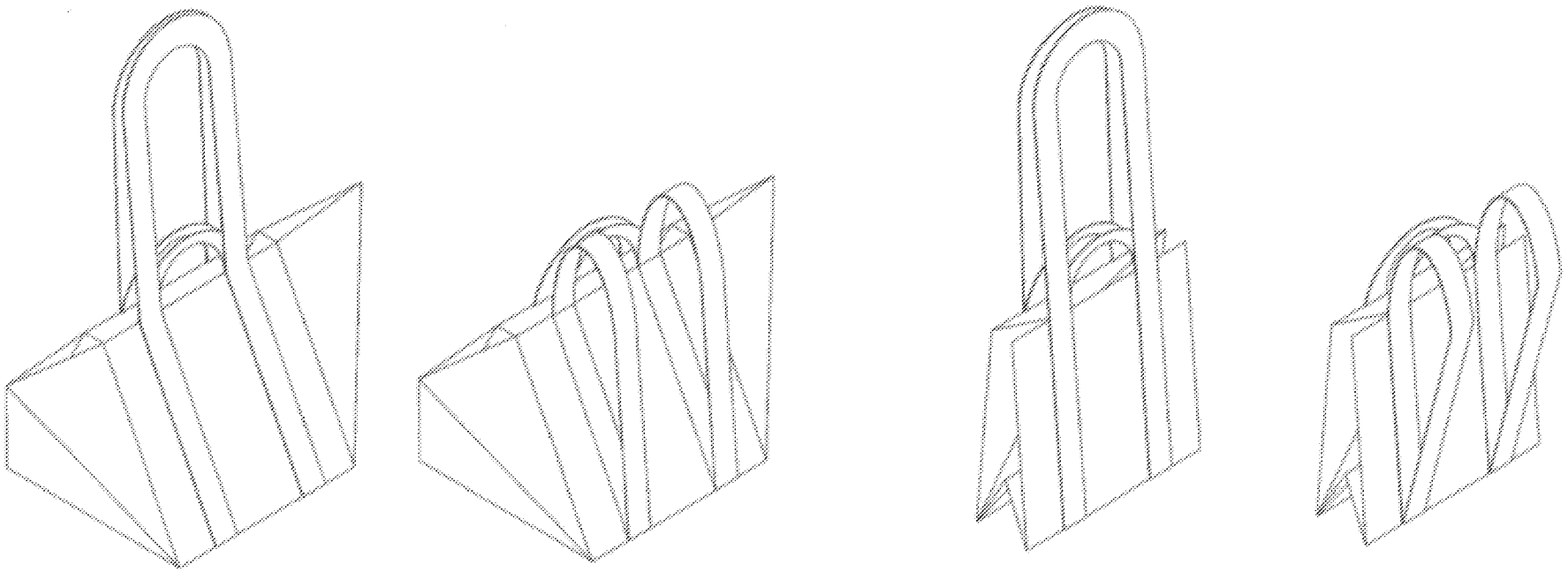

FIG. 13 shows the folded bag with short and long handles and a bag with backpack straps.

A shopping bag with backpack straps, a shopping bag with short and long handles, and finally a shopping bag folded in with backpack straps are shown.

What is claimed is:

1. A method for forming a bag from a square or rectangular shaped sheet, the method comprising:

dividing the sheet into nine fields using twelve points A, B, D, E, F, H, I, J, L, M, N, and P so that the nine fields are described on lines A to E, E to I, I to M, and M to A, and B to L, D to J, F to P, and H to N so that the nine fields are arranged such that eight fields surround a central field;

making four cuts from point B to a point A1, from point D to a point E1, from point J to a point I1, and from a point L to a point M1;

folding the sheet along folding-lines between and across the fields in such a way that the central field forms the bottom of the bag and the eight surrounding fields form the sides of the bag and at least one inner wall providing separated compartments in the bag; and assembling the sections to form a bag having one central compartment and compartments on two opposing sides of the central compartment, wherein the folding comprises:

folding the sheet:

in a folding-line from point P to point B so that point A is folded to meet a point Q;

in a folding-line from point D to point F so that point E is folded to meet a point R:

in a folding-line from point H to point J so that point I is folded to meet a point S; and in a folding-line from point L to point N so that point M is folded to meet a point T;

folding the sheet further with a fold from point F to point P and a fold from point H to point N, then fold the sheet from point D to point J and from point B to point L and bend upwards;

bending up the fields defined by the lines between points B to D, D to R, R to O, and Q to B, and the lines between points J to L, L to T, T to S, and S to J, whereby the sections formed by the cuts, from point B to a point A1, from point D to a point E1, from point J to a point I1, and from point L to a point M1, overlap each other so that the fields defined by the lines between points B to D, D to R, R to Q, and Q to B and the lines between points J to L, L to T, T to S, and S to J are bent so that they stand substantially vertically on the field defined by the lines between points Q to R, R to S, S to T, and T to Q.

2. The method according to claim 1, wherein the bag is assembled by gluing, sewing, welding, rivets, or clips.

3. The method of claim 1, wherein the sheet is made from paper, cardboard, leather, fabric, biodegradable materials, plastics, or metal.

4. The method according to claim 1, further comprising the steps of:

assembling point B and point P such that the line between point A and point B is flush with the line between point Q and point R;

assembling point D and point F such that the line between point D and point E is flush with the line between point Q and point R;

assembling point H and point J such that the line between point I and point J is flush with the line between point S and point T;

assembling point L and point N such that the line between point L and point M is flush with the line between point S and point T.

5. The method according to claim 1, wherein the area defined by the lines A to B, B to L, L to M, and M to A are divided into three squares, and the area defined by the lines D to E, E to I, I to J, and J to D are divided into three squares.

6. The method according to a claim 1, wherein point B meets point D, and point L meets point J.

7. The method according to claim 1, wherein the bag by attachment of bent end pieces—formed by lines between points B, D, R, and Q, and points J, L, T, and S, respectively—appears as a bag with one compartment.

8. The method according to claim 1, wherein end pieces—formed between the points B, D, R, and Q, and the points J, L, T, and S, respectively—are folded out such that they, by a fold from point C to point Q and a fold from point C to point R, and a fold from point K to point S and a fold from point K to point T, form at least two compartments.

9. The method according to claim 1, wherein end pieces—formed between the points B, D, R, and Q, and the points J, L, T, and S, respectively—are folded by folding a line from point C to point Q and folding a line from point C to point R and further folding a line from point K to point S and folding a line from point K to point T so point C and K can meet with point G and point O.

10. The method according to claim 1, wherein end pieces—formed between the points B, D, R, and Q, and the points J, L, T, and S, respectively—and the bottom are folded in.

11. The method according to claim 1, where the bag is provided with short and long handles and/or with backpack straps.

12. A shopping bag produced by the method according to claim 1.

13. A method for forming a bag from a square or rectangular shaped sheet comprising a first pair of opposite edges, a second pair of opposite edges, a first, a second a third and a fourth sheet corner points, the method comprising:

dividing the sheet into nine fields comprising a central field defined by central field corner points and eight surrounding fields comprising four corner fields and four non-corner fields, each non-corner field being defined by four corner points, a first of the corner fields being defined by the first sheet corner point, two edge points and a first central field corner point; a second of the corner fields being defined by the second sheet corner point, two edge corner points and a second central field corner point; a third of the corner fields being defined by the third sheet corner point, two edge corner points and a third central field corner point; a fourth of the corner fields being defined by the fourth sheet corner point, two edge corner points and a fourth central field corner point;

making a cut in each of the corner fields from a respective edge corner point of said respective corner field to a central point of said respective corner field, wherein respective edge corner points are located at said first pair of opposite edges of said sheet; and folding the sheet along folding-lines between and across the fields to provide that the central field forms a bottom of the bag and the four non-corner fields form sides of the bag and wherein the corner fields being folded and assembled to form at least one inner wall providing separated compartments in the bag.

14. The method according to claim 13, wherein the sheet is a square sheet and the method comprises the steps of:

dividing the square sheet into said nine fields using twelve points forming said corner points of said fields so that the nine fields are arranged in three first direction rows of three fields in a first direction and three second direction rows of three fields in a second direction perpendicular to said first direction, wherein said first direction rows are separated by first direction folding lines and said second direction rows are separated by second direction folding lines;

making said cut in each of the corner fields;

folding each corner field to provide that the respective first, second third and fourth sheet corner point meet said respective first, second, third and fourth corner point of said respective corner fields;

folding the sheet further with a fold in each of said first direction folding lines and then fold the sheet in each of said second direction folding lines;

bending up the non-corner fields so that they stand substantially vertically central field;

assembling the corner and non-corner fields to form a bag having one central compartment and compartments on two opposing sides of the central compartment.

15. The method according to claim 13, comprising the further steps of:

assembling pair wise respective edge portions of said first pair of opposite edges forming respective edges of said respective corner folds to flush with portions of said first direction folding line forming respective edges of said central field.

16. The method according to claim 13, wherein end pieces are formed of respective non-corner fields of said first direction rows and located along said first pair of opposite edges and the method comprises folding said end pieces forming non-corner fields along middle folding line perpendicular to said first pair of opposite edges such that the end pieces are folded out to form at least two compartments between respective end piece and respective assembled pair of corner fields.

17. The method according to claim 13, wherein end pieces are formed of respective non-corner fields of said first direction rows and located along said first pair of opposite edges and the method comprises folding each of said end pieces forming non-corner fields along folding lines extending from a middle point between said two corner points of said respective pieces forming non-corner fields located at said first pair of opposite edges to respectively said two corner points of said respective pieces forming non-corner fields located at said respective first direction folding lines to provide that opposite middle edge points can meet, wherein the opposite middle edge points are edge points of respective non-corner fields of a middle first direction row and being located at said respective second pair of opposite edges.

* * * * *